US005365222A

United States Patent [19]

Robinette et al.

[11] Patent Number: 5,365,222

[45] Date of Patent: Nov. 15, 1994

[54] METHOD AND DETECTOR FOR DETECTING SURFACE ROUGHNESS OR DEFECTS ON COATED WIRE OR CABLE

[75] Inventors: Jean Robinette, Montreal; Jack Mark, Laval; André Laramée, Montreal, all of Canada

[73] Assignee: Alcatel Canada Wire Inc., North York, Canada

[21] Appl. No.: 86,017

[22] Filed: Jul. 2, 1993

[30] Foreign Application Priority Data

Dec. 11, 1992 [CA] Canada ..... 2085160-1

[51] Int. Cl.[5] ..... G08B 21/00

[52] U.S. Cl. ..... 340/677; 340/673; 139/353; 28/185; 28/187; 66/161; 250/561

[58] Field of Search ..... 340/677, 674, 673; 19/0.23; 28/185, 187, 186; 66/161, 163, 160; 112/273, 278; 139/353; 250/261

[56] References Cited

U.S. PATENT DOCUMENTS

| | | | |
|---|---|---|---|
| 3,827,296 | 8/1974 | Hidaka | 340/677 |
| 3,995,417 | 12/1976 | Lumpert et al. | 340/677 |
| 4,133,207 | 1/1979 | Weidmann et al. | 340/677 |
| 4,797,662 | 1/1989 | Graham et al. | 340/677 |
| 5,105,855 | 4/1992 | Stacher | 28/187 |
| 5,206,709 | 4/1993 | Schewe et al. | 250/561 |

*Primary Examiner*—Edward L. Coles, Sr.
*Assistant Examiner*—Fan Lee
*Attorney, Agent, or Firm*—Ware, Fressola, Van Der Sluys & Adolphson

[57] ABSTRACT

A method and detector are provided for accurately and continuously detecting surface roughness or oversize defects on coated wire or cable, such as magnet wire. This is achieved by passing the wire or cable through a die having an opening which is larger than the cross-section of the wire or cable by the size of the surface roughness or defect to be detected. This die is pulled on the wire or cable when engaged by the oversize defect to a spot or position where a sensor is provided to sense the presence of the die and thus of the defect and then produce a suitable alarm.

12 Claims, 2 Drawing Sheets

METHOD AND DETECTOR FOR DETECTING SURFACE ROUGHNESS OR DEFECTS ON COATED WIRE OR CABLE

This invention relates to a method and a detector for detecting surface roughness or defects on coated wire or cable.

It is well known that when electrical wire or cable is insulated or a magnet wire is enamelled, which is normally done through a coating operation, there are many internal and external factors that may cause irregularities in the coated surface. These may be dirt encrustations due, for example, to a dirty capstan or, in magnet wire, may be due to blemishes in the enamel that has been burnt while passing through the enamelling oven, or the like.

Up to now, there has been no reliable cost effective method for detecting these blemishes or defects during manufacture of the wire or cable. Visual examination or human touch were the most common methods of detecting such defects, however, they are rather unsatisfactory, since they make it difficult, if not impossible, to monitor the total surface throughout the total length of the wire or cable. Also they are subject to human error.

Some attempts have been made in the past to detect automatically oversize defects in filaments or yarns. An apparatus for such detection is disclosed in Canadian Patent No. 911,717 of Oct. 10, 1972 granted to Du Pont of Canada Limited. This apparatus comprises a guide having a slot through which the yarn or filament is passed and when an oversize defect is passed through the slot it deflects the guide which activates a strain gauge that produces a signal indicating an oversize defect in the yarn or filament.

Because the wires or cables would require monitoring over the total area, passing them through such a slot would not be satisfactory since it does not encompass the entire outer shape of the wire or cable.

U.S. Pat. No. 3,875,667 of Apr. 8, 1975 issued to David J. Wilke, discloses a device for determining the straightness of a running length of wire or rod using sensor means disposed perpendicular to each other and to the longitudinal axis of the wire or rod and display means connected to the sensor means for displaying the detected deviation. Again such system would not be suitable for detecting roughness or defects throughout the surface area of a running wire or cable as it leaves a lot of the area not checked by the sensors.

It is, therefore, the object of the present invention to provide a novel method and detector for accurately and continuously detecting surface roughness or oversize defects on coated wire or cable, such as magnet wire, insulated electrical cable and the like. The wire or cable, which may have any cross-sectional shape, be it round or rectangular, is coated and then wound on a reel in a continuous operation. Coating includes any continuous provision of insulation on the wire or cable, such as enamelling on magnet wire or extrusion on electrical wire or cable.

To achieve the above object, a method is provided in accordance with the present invention, which comprises:

(a) passing the wire or cable through a die after a coating operation, but prior to it being wound on a reel, said die having an opening which is larger than the cross-section of the wire or cable by the size of surface roughness or defect to be detected and is adapted to be pulled on the wire or cable when engaged by oversize roughness or defect on the surface of the wire or cable as it passes through the die; and (b) sensing the presence of the die as it reaches a predetermined spot while being pulled on the wire or cable and producing a signal detecting the oversize roughness or defect on the surface of the wire or cable.

The detector for detecting oversize surface roughness or defects on a coated wire or cable in accordance with the present invention comprises:

(a) a die mounted around the wire or cable as it travels after a coating operation to be wound on a reel, which die has an opening which is larger than the cross-section of the wire or cable by the size of surface roughness or defect to be detected, said die being adapted to be pulled on the wire or cable when engaged by oversize roughness or defect on the surface of the wire or cable as it passes therethrough prior to being wound on a reel; and (b) means for sensing the presence of the die when it reaches a predetermined spot while being pulled on the wire or cable and for producing a signal detecting the oversize roughness or defect on the surface of the wire or cable.

The opening of the die will usually be precisely calibrated so that it is only slightly larger than the diameter (or the cross-section if it is a shaped wire or cable) of the wire or cable passing therethrough. For example, it may be sized 1–3 mils larger than the diameter of the wire or cable.

A proximity sensor may be used to detect the die as it is pulled on the wire or cable when it reaches a predetermined spot or position. Such proximity sensors are well known in the art and they usually operate, for example, in sensing the presence of a magnetic substance, if the die is made of metal with magnetic properties. Other non-contact sensors, using, for example, eddy-current proximity transducers, or photoelectric cells, can also be used.

Moreover, contact sensors can be employed in accordance with the present invention to detect the presence of the die. In this manner, the die is pulled on the wire or cable until its side or edge contacts, for example, a piezoelectric transducer provided at a certain spot nearby, which would detect the presence of the die and thus of the defect.

The non-contact or contact sensor arrangement produces an electrical signal which can be readily transformed into a visual or audible alarm, such as a light, a sound or both. Preferably the signal passes through a PLC (programmable logic controller) where a suitable program is used to provide an appropriate alarm. For example, the alarm could only be triggered when at least ten oversize defects or granules are detected within a period of five minutes or when the defect is so large that it maintains the die at the predetermined spot for longer than ten seconds. Such a program can readily be developed by a person familiar with the art of programming and can be adapted to any desired situation. It should also be understood that a number of wires or cables are usually run in parallel at the same time and each is provided with a die and a non-contact or contact sensor. Then, when one of the wires or cables is found to have an oversize granule or defect, it produces a signal which is processed by the PLC to show which of the wires or cables has the defect and gives an appropriate indication to the operator, for example, by having a light blink, relating to such wire or cable.

When reference is made herein to a die, it is made to a die such as used for magnet wire enamelling. It can, however, be any element which is fairly light and stable and which can be pulled when engaged by a granule or other oversize defect on the wire or cable surface. Its opening is such that it can further open under a given pressure, so that the wire or cable would pass therethrough even with the defect, without stopping the overall operation each time a defect is detected.

This invention may be used with any type of coated wire and cable. For example, the coating may be an insulation or an enamel, as in the case of magnet wire. Also it can be used with any shape or cross-section of wire or cable, provided a suitable die is designed therefor. However, this technique may not be applicable to very thin or small size wires (<35 awg) because they are not strong enough and could break when a defect is engaged by the die. Thus, the wire or cable must be strong enough to withstand engagement with the die and the pull of the same to the detection system and then release thereof under pressure, without breaking said wire or cable in the process.

The invention provides a significant advantage in detecting surface irregularities and defects on coated wires and cables over the total area thereof, and signalling the operator who can then undertake proper corrective actions. This results in considerable scrap reductions.

The invention will now be described with reference to the appended drawings in which.

Figure 1:
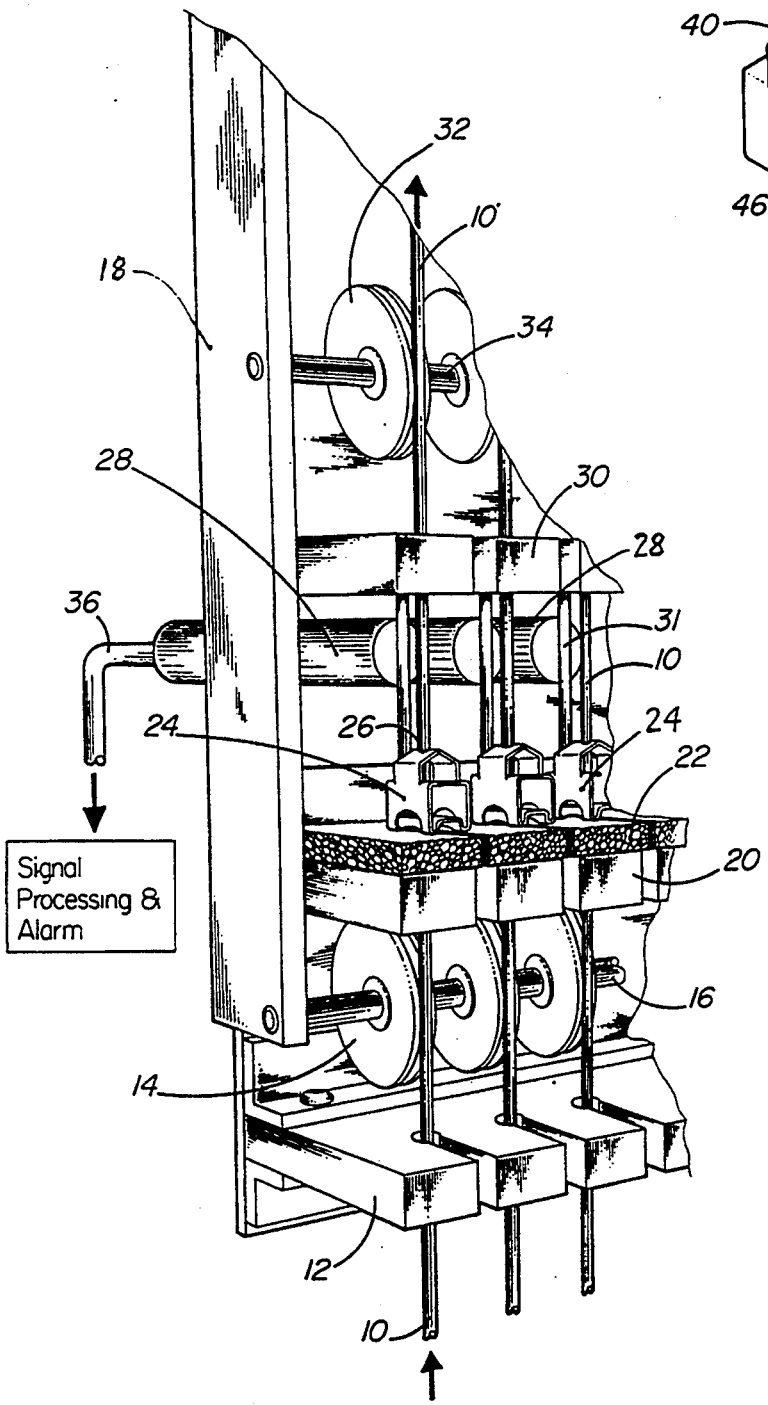
FIG. 1 is a view, in perspective, illustrating the detecting system of the present invention.

Referring now to FIG. 1, the coated wire 10 travels upwards through an opening in a platform 12 and within the groove of tension pulley 14 which maintains the required tension to keep the wire straight. Pulley 14 rotates on axle 16 fixed by one end to a side frame element 18 and by the other end to a similar frame element (not shown). It should be understood that a plurality of such wires are run simultaneously in parallel to one another, however to simplify the description, only three are shown in FIG. 1.

The wire 10 then passes through another opening in the platform 20 having on the top surface thereof a cushioning layer 22 on top of which is positioned a die 24. Wire I0 passes through the opening 26 of die 24. This opening 26 is precisely calibrated so that if wire 10 has an oversize surface roughness or a granule on its coating, it will engage and pull the die 24 upwards towards the proximity sensor 28 which may, for example, be of the type IGA-2008-FRKG-2 wire 10–55v DC. A guiding rod 31 may also be provided so that die 24 would not sway from its normal position while being raised on wire 10 towards sensor 28. When die 24 has reached the spot where sensor 28 is positioned it abuts with its upper end against platform 30 and as wire 10 continues to be pulled upward it passes through the hole 26 because the top end of the die forming a kind of a roof, opens under pressure and allows the passage of the wire therethrough even when the oversize defect is present. In this manner, the continuous operation is not interrupted. Thereafter, die 24 falls back to its normal position on cushion 22 as shown in FIG. 1.

After passing through an opening in platform 30, the wire 10 again goes through the groove of another tension pulley 32 mounted and turning on axle 34, the end of which is secured to side frame element 18. The platforms 12, 20 and 30 are preferably made of rigid plastic plates and are assembled to provide a good solid framework for the system. Obviously other materials can be used and other arrangements can be made without departing from the spirit of the invention.

When die 24 is raised to the level of sensor 28 due to the presence of roughness or defect in wire 10, it triggers said sensor 28 which thereby produces an electric signal which is transmitted through electrical cable 36 to signal processing and activation of a suitable alarm such as a flashing light or an audible sound or the like.

Figure 2:
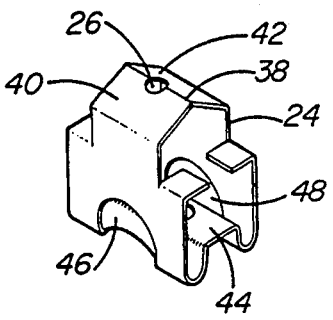
FIG. 2 is a view, in perspective, showing a die suitable for the purposes of the present invention.
Figure 3:
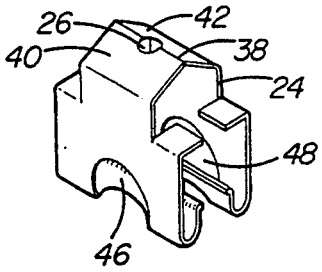
FIG. 3 is a view, in perspective, of the same die as in FIG. 2 but shown from the opposite end.

FIG. 2 and FIG. 3 illustrate the die 24 which is commonly used in magnet wire enamelling and which is suitable for the purposes of the present invention. It has an opening 26 in the middle, which is precisely calibrated to be only slightly larger than the diameter of the wire 10. Its upper edge 38, in the form of a roof, opens under pressure from within, i.e. it is not solidly connected, but the two faces 40 and 42 are merely pressed against one another. At one end, the two side walls of the die 24 are interconnected by lateral surface 44 at the bottom, as shown in FIG. 2, while at the other end the bottom is left open. This is particularly suitable for meshing with the guiding rod 31 and thereby keeping the die in the desired position while it is raised on wire 10.

Such dies are usually stamped out of copper or copper alloy and to make them lighter, circular openings 46, 48 are provided on each side wall. Such dies are, therefore, well suited for use with the present invention, since they are stable, light enough to be raised or pulled on the wire 10 in the presence of surface defects and come with many precisely calibrated openings 26. However, it should be understood that any "die" or element which is stable, sufficiently light and has a precise opening of a desired shape and calibration can be employed.

Also the arrangement shown in FIG. 1 is vertical since this is the most convenient positioning. It allows for die 24 to fall back by gravity after being raised and released. However, one could envisage a horizontal arrangement as well, where the die would be held in its desired position, for example, by magnetism or the like, and would return to that position by magnetic pull after being released.

Figure 4:
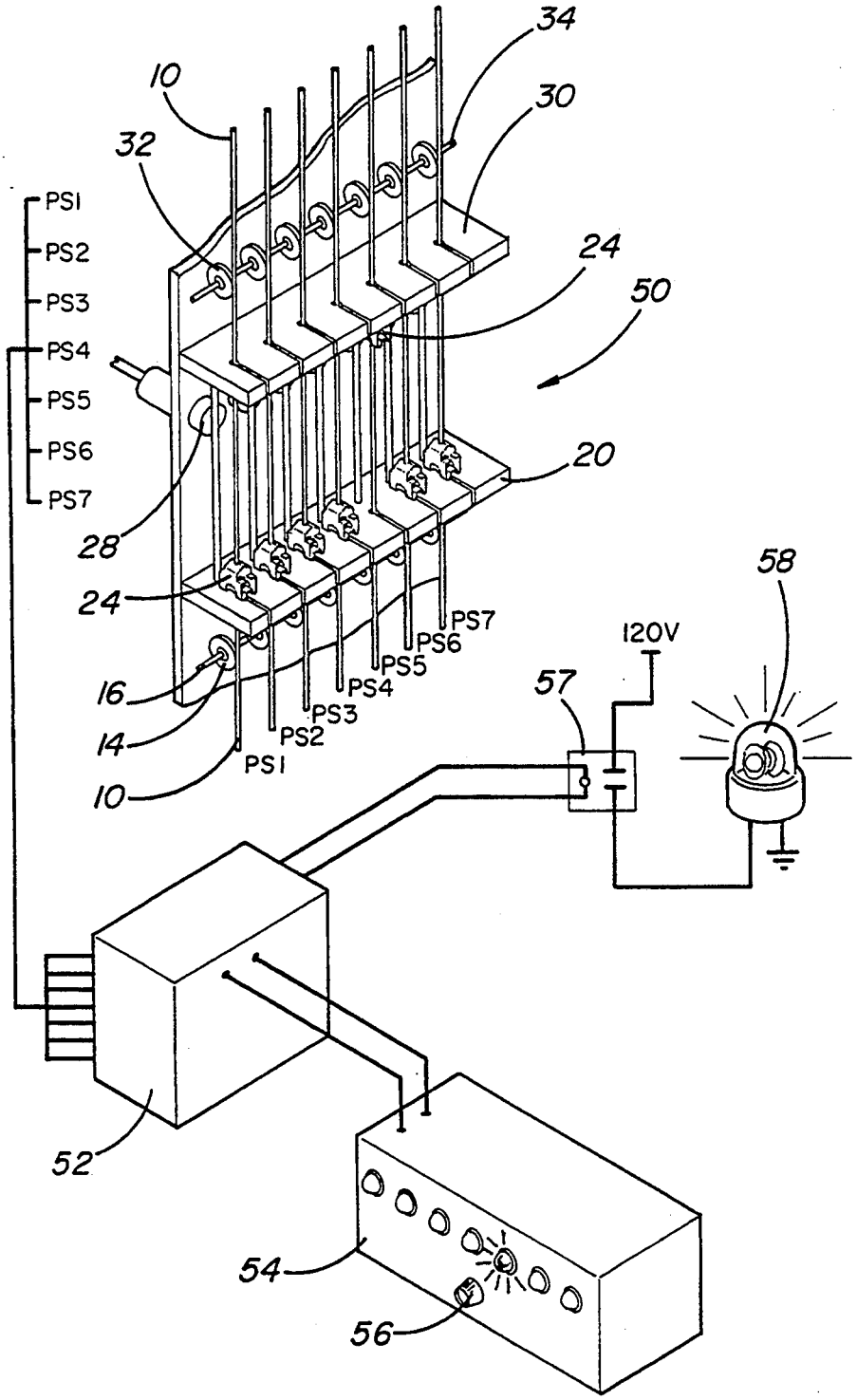
FIG. 4 shows schematically, in perspective, an overall arrangement for detecting surface roughness or defects on coated wire or cable in accordance with this invention.

In FIG. 4 there is illustrated an arrangement 50 for a line of seven wires running in parallel. Each is set up as described with reference to FIG. 1 in position PS1, PS2, PS3, PS4, PS5, PS6, and PS7. In the arrangement illustrated, die 24 in PS5 has been raised to a spot where it is detected by its sensor 28 and an electrical signal is then communicated to PLC 52, which is a programmable logic controller or computer that is programmed to give an appropriate command to the control panel 54 for switching on the fifth flashing light indicating that it is the fifth position or PS5 that has encountered a problem of wire defect. The operator can then, if he judges appropriate, stop that line using STOP-START button 56 and make the required corrections before restarting the operation at that position. Also, to warn from a distance that a problem has been encountered, a gyrophare 58 or other similar alarm may be activated by the PLC 52 through a relay 57. A sound alarm may also be used to attract the attention of an operator.

It should be pointed out that the above description of the preferred embodiment does not limit the scope of the invention as claimed in the following claims.

We claim:

1. A method for detecting surface roughness or defects in a coated wire or cable, which comprises:

(a) passing the wire or cable through a die after a coating operation, but prior to it being wound on a reel, said die having an opening which is generally equal to a desired cross-section of the wire or cable and is adapted to be pulled on the wire or cable when engaged by oversize roughness or defect on the surface of the wire or cable creating a cross-section larger than the opening as the oversize roughness or defect passes through the die; and (b) sensing the presence of the die as it reaches a predetermined spot while being pulled on the wire or cable and producing a signal detecting the oversize roughness or defect on the surface of the wire or cable.

2. Method according to claim 1, wherein the wire is a magnet wire and is coated with a coating of enamel prior to being passed through the die.

3. Method according to claim 1, wherein the cable in an electrical cable and is coated with a coating of insulation prior to being passed through the die.

4. Method according to claim 1, wherein once the presence of the die has been sensed, a signal is produced which is processed to trigger a desired alarm.

5. Method according to claim 4, wherein the signal processing is done by a programmable logic controller.

6. A detector for detecting surface roughness or defects on a coated wire or cable which comprises:

(a) a die mounted around the wire or cable as it travels after a coating operation to be wound on a reel, said die has an opening which is generally equal to a desired cross-section of the wire or cable, said die being adapted to be pulled on the wire or cable when engaged by an oversize roughness or defect on the surface of the wire or cable creating a cross-section larger than the opening as the oversize roughness or defect passes through the die prior to being wound on the reel; and (b) sensing means for sensing the presence of the die when it reaches a predetermined spot while being pulled on the wire or cable and for producing a signal detecting the oversize roughness or defect on the surface of the wire or cable.

7. A detector according to claim 6, wherein the die consists of an element which is stable when the wire or cable passes through the opening therein and is light enough to be pulled by the oversize roughness or defect to the spot where it can be sensed by the sensing means.

8. A detector according to claim 6, wherein means are further provided to release the die and return it to its original position after the oversize roughness or defect on the surface of the wire or cable has been detected.

9. A detector according to claim 6, wherein the sensing means consist of a non-contact proximity sensor.

10. A detector according to claim 6, wherein the sensing means consist of a contact sensor.

11. A detector according to claim 6, wherein a processor is provided to process the signal produced by the sensing means and to trigger a suitable alarm.

12. A detector according to claim 11, wherein the processor is a programmable logic controller.

* * * * *